US005439361A

United States Patent [19]

Reynolds et al.

[11] Patent Number: 5,439,361

[45] Date of Patent: Aug. 8, 1995

[54] OIL SHIELD

[75] Inventors: Ernest F. Reynolds, Mexico; James C. Wilson, Cazenovia, both of N.Y.

[73] Assignee: Carrier Corporation, Syracuse, N.Y.

[21] Appl. No.: 220,859

[22] Filed: Mar. 31, 1994

[51] Int. Cl.[6] ..... F04C 18/04; F04C 29/02; F01M 11/00

[52] U.S. Cl. ..... 418/55.6; 418/94; 418/151; 184/6.27

[58] Field of Search ..... 418/55.6, 94, 151; 184/6.27

[56] References Cited

U.S. PATENT DOCUMENTS 5,055,010 10/1991 Logan ..... 418/55.6

FOREIGN PATENT DOCUMENTS 63-32190 2/1988 Japan ..... 418/151

*Primary Examiner*—John J. Vrablik

[57] ABSTRACT

Draining lubricant tends to be slung off of radially extending surfaces of the rotating shaft and entrained by the suction gas. This is prevented by providing an oil shield which collects the slung oil and directs it downwardly out of the path of the flowing suction gas.

4 Claims, 1 Drawing Sheet

OIL SHIELD

BACKGROUND OF THE INVENTION

There is an affinity between refrigerants and the lubricants used in refrigeration compressors. As a result, the refrigerant circulating through the refrigeration system tends to contain some lubricant. The presence of lubricant interferes with heat transfer in the refrigeration system and the carry-over of lubricant may result in an inadequate amount of lubricant being available for lubricating the compressor. To minimize the carry-over of lubricant to the refrigeration system, the lubricant may be removed from the suction gas supplied to the pump structure or from the discharge gas before it passes into the heat exchange structure.

SUMMARY OF THE INVENTION

In a low side hermetic compressor, suction gas is supplied to the interior of the shell from which it is drawn into the pump structure of the compressor and compressed. Typically, an oil sump is located at the bottom of the shell. Lubricant is drawn from the sump and supplied to the bearings and other parts requiring lubrication. The lubricant drains into the shell and collects in the sump. Since the suction gas, like the lubricant, is flowing in the shell, there is a potential for lubricant entrainment. The present invention directs lubricant slung from the rotating parts away from the path of the suction gas.

It is an object of this invention to minimize entrainment of lubricant by the suction gas.

It is another object of this invention to reduce oil circulation. These objects, and others as will become apparent hereinafter, are accomplished by the present invention.

Basically a shield is provided to collect and direct lubricant slung off of a rotating member so as to prevent its being entrained by the suction gas.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
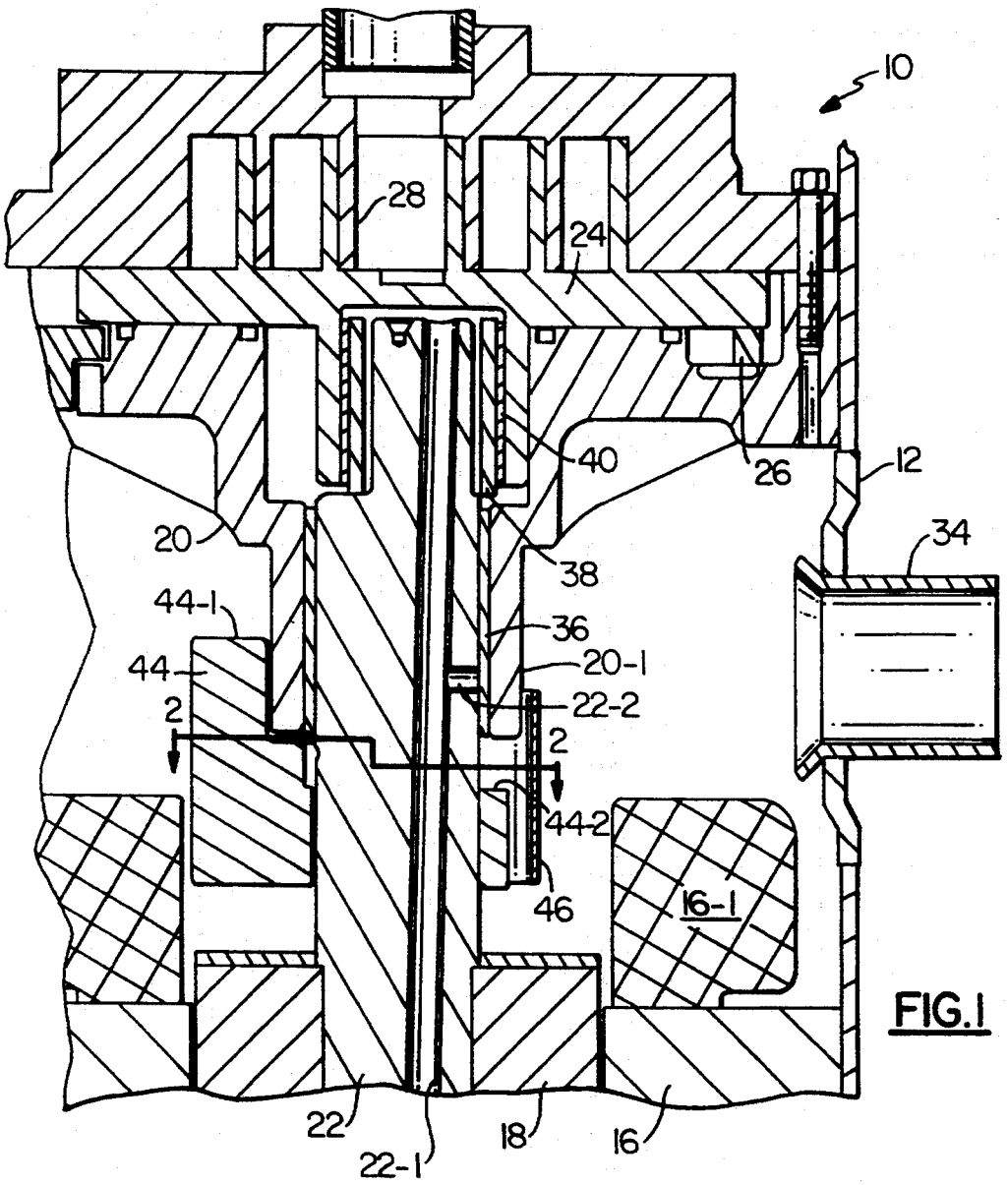
FIG. 1 is a sectional view of a portion of a low side hermetic scroll compressor employing the present invention.
Figure 2:
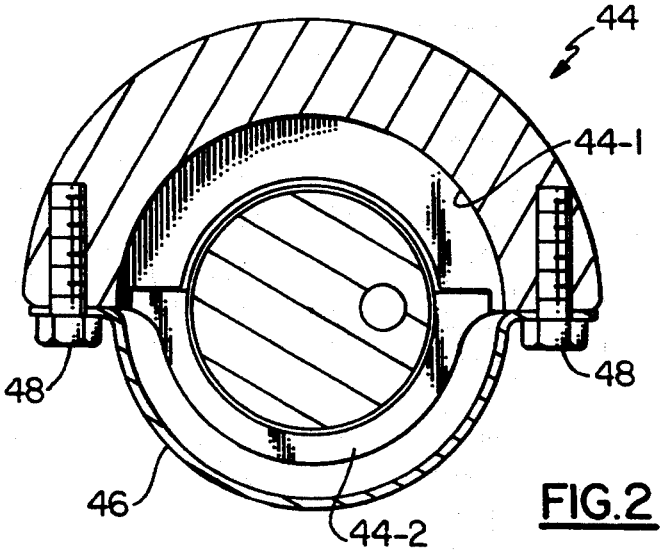
FIG. 2 is a sectional view taken along line 2—2 of FIG. 1.

In FIG. 1, the numeral 10 generally designates a low side hermetic scroll compressor. Compressor 10 includes a shell 12 with crankcase 20 welded or otherwise suitably secured in shell 12. Stator 16 is secured in shell 12 by a shrink fit while rotor 18 is secured to shaft 22 by a shrink fit. Stator 16 and rotor 18 make up a motor, preferably variable speed, which drives shaft 22 and thereby orbiting scroll 24 which is held to an orbiting motion by Oldham coupling 26. Orbiting scroll 24 coacts with fixed scroll 28 to draw gas into the compressor 10, to compress the gas and to deliver it to a refrigeration system (not illustrated). Gas is returned from the refrigeration system and supplied to the compressor 10 via suction inlet 34. In passing from suction inlet 34 to the inlet of scrolls 24 and 28, typically, at least some of the gas is directed over stator 16 to provide motor cooling.

As shaft 22 rotates it acts as a centrifugal oil pump drawing oil from a sump (not illustrated) into offset and/or skewed bore 22-1. Oil is pumped via bore 22-1 to the various locations requiring lubrication. As illustrated, bore 22-1 connects with and feeds bore 22-2 which lubricates the upper bearing 36 and bore 22-1 terminates in orbiting scroll 24 such that oil is provided for lubricating slider block 38 and bearing 40. To help balance the eccentric forces exerted on the shaft 22 by orbiting scroll 24 during the compression process, a counterweight 44 is provided. The counterweight 44 can be part of the shaft 22, but is often shrunk fit onto shaft 22 or attached to rotor 18. The counterweight 44 is preferably located as close to the scrolls as possible to minimize the axial separation of the forces and their tilting effects. Accordingly, the portion, 44-1, of the counterweight 44 providing the force balancing effects is radially outward and partially axially coextensive with the hub portion 20-1, of crankcase 20 supporting bearing 36.

Lubricant supplied via bore 22-1 to bore 22-2 and bearing 36 tends to drain between hub 20-1 and shaft 22. The rotation of the cylindrical shaft tends to cause the oil to flow in a spiral path in the opposite direction of the rotation of the shaft 22 but does not tend to sling the oil therefrom. Axial passage of the draining oil is blocked by the radially extending arcuate surface 44-2 of the counterweight 44. Oil reaching arcuate surface 44-2 is directed radially outward by centrifugal force and tends to sling into the interior of shell 12 in an atomized state which is readily entrained by the suction gas passing through the interior of shell 12.

According to the teachings of the present invention, oil shield 46 is secured to counterweight 44 in any suitable manner such as by bolts 48. Oil shield 46 is preferably made of plastic, sheet metal or any other suitable lightweight material since it has to be counter balanced by the counterweight 44. However, the shield could be integral with the counterweight as for ease of manufacture and assembly. The oil shield 46 is radially separated from radially extending surface 44-2 and extends axially, in both directions, relative to the plane of surface 44-2. In order to predispose oil collecting on oil shield 46 to flow downwardly, the oil shield 46 can be configured to favor downward flow. For example, oil shield 46 can extend axially above surface 44-2 an amount equal to or greater than the amount it extends below surface 44-2. Also, shield 46 can extend radially outwardly in going from the top to bottom so as to form a portion of a frustum of a hollow cone. Due to the presence of oil shield 44, oil slung from surface 44-2 impinges upon the facing inner surface of oil shield 46 and collects there. Since the oil shield 46 is integral with counterweight 44, it rotates therewith so that oil collecting on shield 46 tends to flow downwardly and in a spiral in the opposite direction to the rotation of shaft 20. Shield 46 extends below the suction inlet 34 and has its lower end within the coils 16-1 of stator 16. As a result, oil reaching the bottom of shield 46 tends to collect in drops, in the absence of a significant radial surface defined by the lower edge of shield 46, and is slung, as drops, onto the coils 16-1 of stator 16 from which it drains to the sump. It follows that the oil is not atomized or dispersed into the path of the flowing suction gas.

Although a preferred embodiment of the present invention has been illustrated and described, other changes will occur to those skilled in the art. It is therefore intended that the scope of the present invention is to be limited only by the scope of the appended claims.

What is claimed is:

1. A low side hermetic scroll compressor having a casing containing a crankcase, an orbiting scroll, a shaft operatively connected to said orbiting scroll, motor means including a rotor and stator for driving said shaft and thereby said orbiting scroll, bearing means supporting said shaft in said crankcase, oil distribution means for lubricating said bearing means, counterweight means on said shaft having a first portion partially surrounding and axially coextensive with a portion of said crankcase and a second portion having a radially extending surface axially spaced from said crankcase, suction means secured to said casing and generally located opposite said counterweight means for supplying suction gas whereby when said motor means drives said shaft and thereby said orbiting scroll, oil is supplied to said bearing means and drains onto said radially extending surface which rotates with said shaft and is slung off, the improvement comprising:

oil shield means integral with said counterweight means and located radially outward of and extending axially above and below said radially extending surface whereby said oil slung off of said radially extending surface is collected on said shield means and flows downwardly.

2. The improvement of claim 1 wherein said oil shield means extends axially below said suction means.

3. The improvement of claim 2 wherein said oil shield means axially extends within a portion of said stator.

4. The improvement of claim 1 wherein said oil shield means is made of sheet material so as to minimize its radial extent.

* * * * *